US009487936B2

(12) United States Patent
Sallah

(10) Patent No.: US 9,487,936 B2
(45) Date of Patent: Nov. 8, 2016

(54) APPARATUS FOR EASILY INSTALLABLE /REMOVABLE FAUCET AND METHOD OF SAME

(71) Applicant: Chaim Sallah, Mineola, NY (US)

(72) Inventor: Chaim Sallah, Mineola, NY (US)

( * ) Notice: Subject to any disclaimer, the term of this patent is extended or adjusted under 35 U.S.C. 154(b) by 729 days.

(21) Appl. No.: 13/815,707

(22) Filed: Mar. 14, 2013

(65) Prior Publication Data

US 2014/0265302 A1 Sep. 18, 2014

(51) Int. Cl.
*F16L 41/00* (2006.01)
*E03C 1/04* (2006.01)

(52) U.S. Cl.
CPC ..... *E03C 1/0402* (2013.01); *E03C 1/0401* (2013.01); *Y10T 29/49826* (2015.01)

(58) Field of Classification Search
USPC ..... 285/137.11, 139.1, 140.1, 206–210, 285/367
See application file for complete search history.

(56) References Cited

U.S. PATENT DOCUMENTS 620,484 A * 2/1899 Mueller ..... F16L 41/14 285/210
744,646 A 11/1903 Tietz
803,687 A * 11/1905 Grotewohl ..... F16L 41/14 285/139.1
945,517 A * 1/1910 Goodwin ..... F16L 41/14 251/143
1,309,830 A 7/1919 Wanamaker
1,393,089 A * 10/1921 Collie ..... H01B 17/306 174/31 R
1,562,982 A 4/1925 Muend
1,861,842 A * 6/1932 Creighton ..... F16L 41/08 137/356
3,136,570 A 6/1964 Lee
3,173,227 A * 3/1965 Clark ..... H02G 3/0616 174/650
3,191,974 A * 6/1965 Larson ..... B60B 19/06 280/836
3,322,442 A * 5/1967 Flachbarth ..... H02G 3/185 138/92
3,369,566 A 2/1968 Schmidt
3,727,955 A 4/1973 Carter
3,751,999 A * 8/1973 Jollivet ..... F16B 23/00 285/139.1
3,803,532 A 4/1974 Taxon
3,825,359 A 7/1974 Fulton
3,841,673 A * 10/1974 Kohaut ..... F16B 2/06 285/210
3,982,703 A * 9/1976 Meyers ..... E03C 1/2665 241/46.015
4,094,358 A * 6/1978 Neveux ..... F01P 11/08 165/141
4,356,574 A 11/1982 Johnson
4,850,617 A * 7/1989 Moberly ..... F16L 41/088 285/137.11
4,964,180 A * 10/1990 Harbeke ..... E03C 1/26 210/163

(Continued)

*Primary Examiner* — Aaron Dunwoody
(74) *Attorney, Agent, or Firm* — Richard B. Klar, Esq.; Law Office of Richard B. Klar

(57) ABSTRACT

An apparatus and method in which an adaptor mechanism that can be coupled with a faucet to permit the faucet to be installed or removed from the top of the counter top surface without the need for needing installation connection materials or installation connections underneath the countertop. Lugs or feet underneath the adaptor mechanism secure or firmly grasp the underside of a countertop to secure the adaptor mechanism once coupled to the faucet to the countertop to firmly mount the faucet and adaptor mechanism in place. At least four different embodiments for coupling the faucet with the adaptor mechanism are described.

17 Claims, 8 Drawing Sheets

(56) References Cited

U.S. PATENT DOCUMENTS

| | | | | | |
|---|---|---|---|---|---|
| 4,981,310 | A * | 1/1991 | Belisaire | F16B 21/086 | 285/140.1 |
| 5,104,273 | A * | 4/1992 | Clark | E04H 4/14 | 285/206 |
| 5,188,399 | A | 2/1993 | Durina | | |
| 5,194,156 | A | 3/1993 | Tomchak | | |
| 5,403,043 | A | 4/1995 | Smet | | |
| 5,950,663 | A | 9/1999 | Bloomfield | | |
| 5,951,059 | A * | 9/1999 | Kitamura | F16L 5/02 | 285/124.4 |
| 6,006,784 | A | 12/1999 | Tsutsui | | |
| 6,193,284 | B1 * | 2/2001 | King | F28F 9/10 | 285/139.2 |
| 6,315,334 | B1 | 11/2001 | Garcia | | |
| 6,766,545 | B2 * | 7/2004 | Hodges | E03C 1/20 | 210/164 |
| 7,979,929 | B2 | 7/2011 | Vogel | | |
| 8,272,083 | B1 | 9/2012 | Liston et al. | | |
| 8,365,770 | B2 | 2/2013 | Thomas | | |
| 2004/0160055 | A1 * | 8/2004 | Newton | F16L 5/08 | 285/21.1 |
| 2007/0044232 | A1 | 3/2007 | McNerney et al. | | |

* cited by examiner

APPARATUS FOR EASILY INSTALLABLE /REMOVABLE FAUCET AND METHOD OF SAME

BACKGROUND OF THE INVENTION

1. Field

The present invention relates to an apparatus for easily installing/removing a faucet and a method for the same. In particular the present invention provides for an adaptor mechanism that can be coupled with a faucet to permit the faucet to be installed or removed from the top of the counter top surface without the need for needing installation connection materials or installation connections underneath the countertop.

2. The Related Prior Art

Faucet connections are known in the prior art. Typically such connections require considerable work and effort underneath the countertop and sink to install, remove and/or replace the faucet from the pipe connections. This can be a complex and time consuming effort and can require replacement components underneath the countertop. In addition a skilled person has a plumber may be required to handle this complex removal/installation. It would be desirable if an apparatus and method were available that would make it possible to remove/install a faucet form the top of the countertop without the need for any removal/installation effort or equipment below the countertop.

SUMMARY OF THE INVENTION

It would therefore be desirable to provide an apparatus and a method that overcomes the drawbacks of the aforementioned prior art proposals and provides for the removal/installation of a faucet from the top of the countertop without the need for any removal/installation effort or equipment below the countertop. The present invention provides for such an apparatus and method in which an adaptor mechanism that can be coupled with a faucet to permit the faucet to be installed or removed from the top of the counter top surface without the need for needing installation connection materials or installation connections underneath the countertop.

The present invention further provides for lugs or feet underneath the adaptor mechanism that can secure or firmly grasp the underside of a countertop to secure the adaptor mechanism once coupled to the faucet to the countertop to firmly mount the faucet and adaptor mechanism in place. The present invention provides at least four different embodiments for coupling the faucet with the adaptor mechanism. Other improvements and modifications will become apparent from the forthcoming description and drawings as described below in which:

DETAILED DESCRIPTION OF THE PREFERRED EMBODIMENTS

Figure 1A:
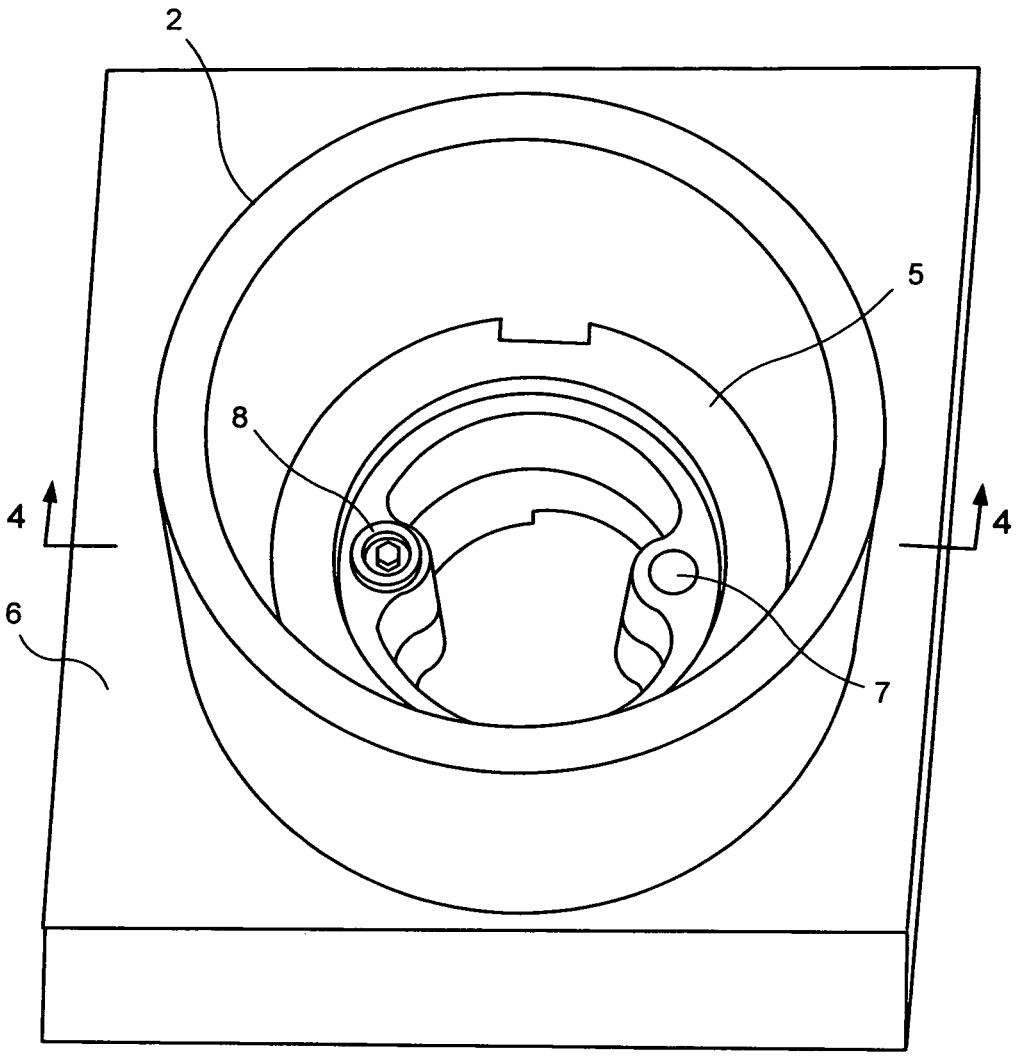
FIG. 1A shows a perspective top view of the faucet connected with the adaptor mechanism of the present invention and secured to a countertop in which the bore holes showing the screws connecting the lugs or feet of the adaptor mechanism to the countertop are shown.
Figure 1B:
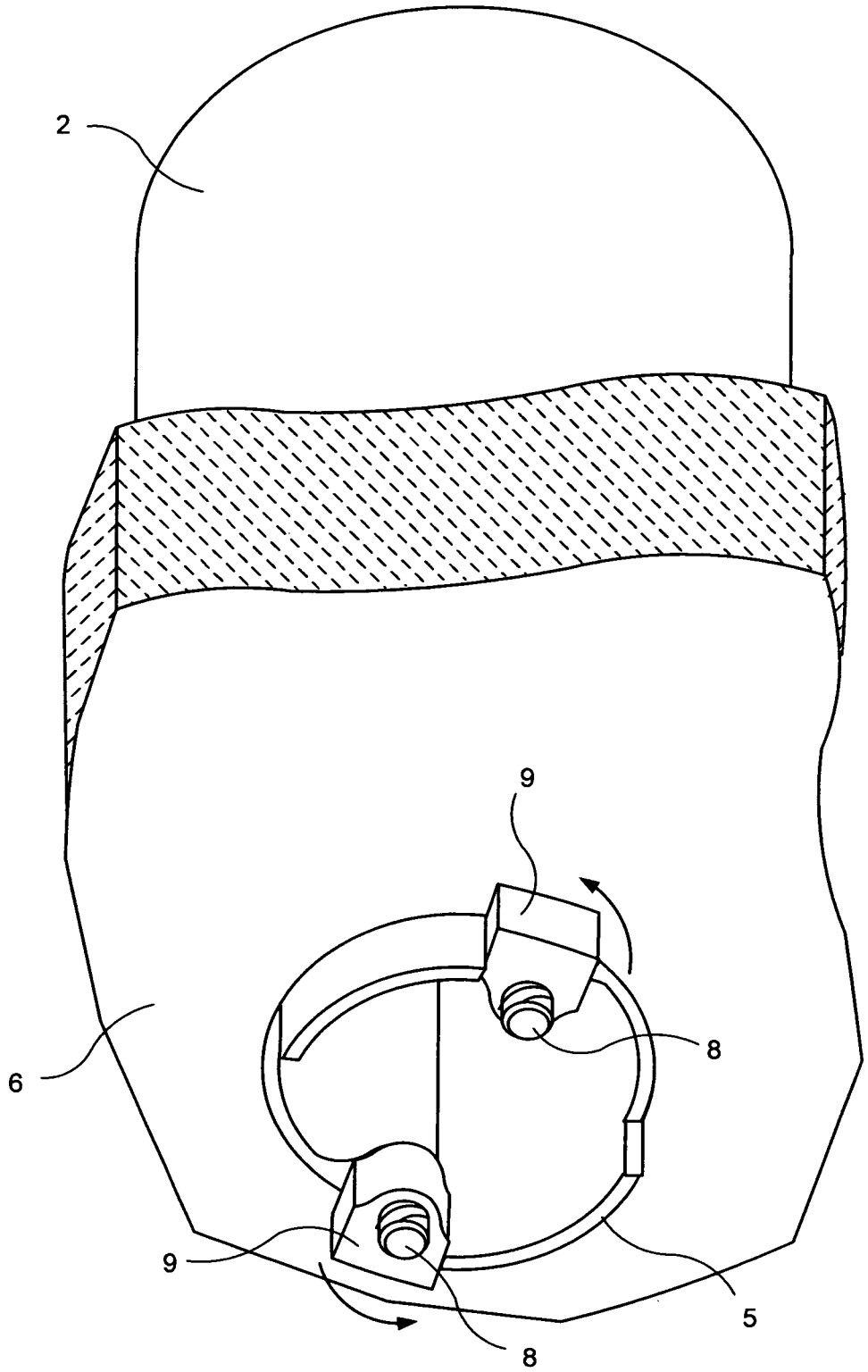
FIG. 1B shows a perspective bottom view of the faucet connected with the adaptor mechanism of the present invention shown in FIG. 1A secured to a countertop showing the lugs or feet of the adaptor mechanism connected to the countertop.

Referring now to the drawings of FIGS. 1-6, FIG. 1A is a perspective view of the faucet 2 connected with the adaptor or adaptor mechanism 5 of the present invention. The adaptor mechanism is 5 secured to a countertop 6 in which the bore holes 7 showing the screws 8 connecting the swinging locks or lugs or feet 9, which can be two or three feet 9 of the adaptor mechanism 5, to the countertop 6 as shown. The swinging locks or feet 9 are threadably connected to the bottom portions of the screws extending through the bore holes. In this manner the feet or lugs 9 can be securely fastened to the countertop 6 by adjusting and rotating the screws 8 on top of the adaptor mechanism 5 above the countertop 6 as shown in the sectional view of FIG. 1B. Thus the installation is accomplished by sliding the adapter 5 with the two (or perhaps three) swinging locks or feet 9 through the mounting hole of the interior of the faucet 2. By turning the two connecting elements or screws clockwise, the two swinging locks 9 turn 180 degrees to their stop and moving upwards towards the bottom of the countertop, until the adapter 5 is secured. The adapter 5 also has a groove for an o-ring or silicone to prevent water from leaking through the surface, the faucet itself has two short tongs which slides into the matching grooves of the adapter, all the way and then by turning the faucet to the right, those tongs engaging into angled groove which secure the faucet downward, a small set screw can keep the faucet in location.

Figure 2:
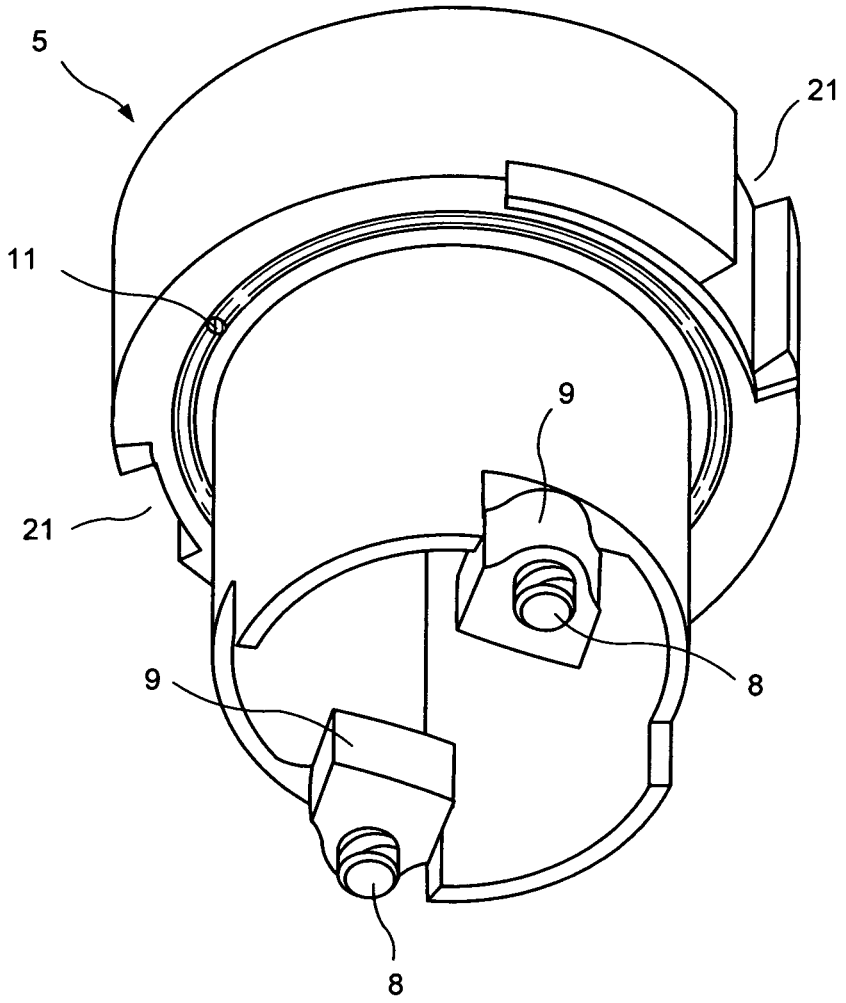
FIG. 2 shows a bottom view of the adaptor mechanism having a silicon ring or an o ring that can be placed thereon to prevent water from going down into the sink cabinet.

The faucet 2 and the adaptor mechanism can be coupled to together in one of several ways as described in the embodiments of FIGS. 2-5 described below. For each of these four embodiments a silicon ring 11 or a ring of any other suitable commercial material can be placed on the adaptor 5 to prevent water from going down into the sink cabinet as shown in FIG. 2

Figure 3A:
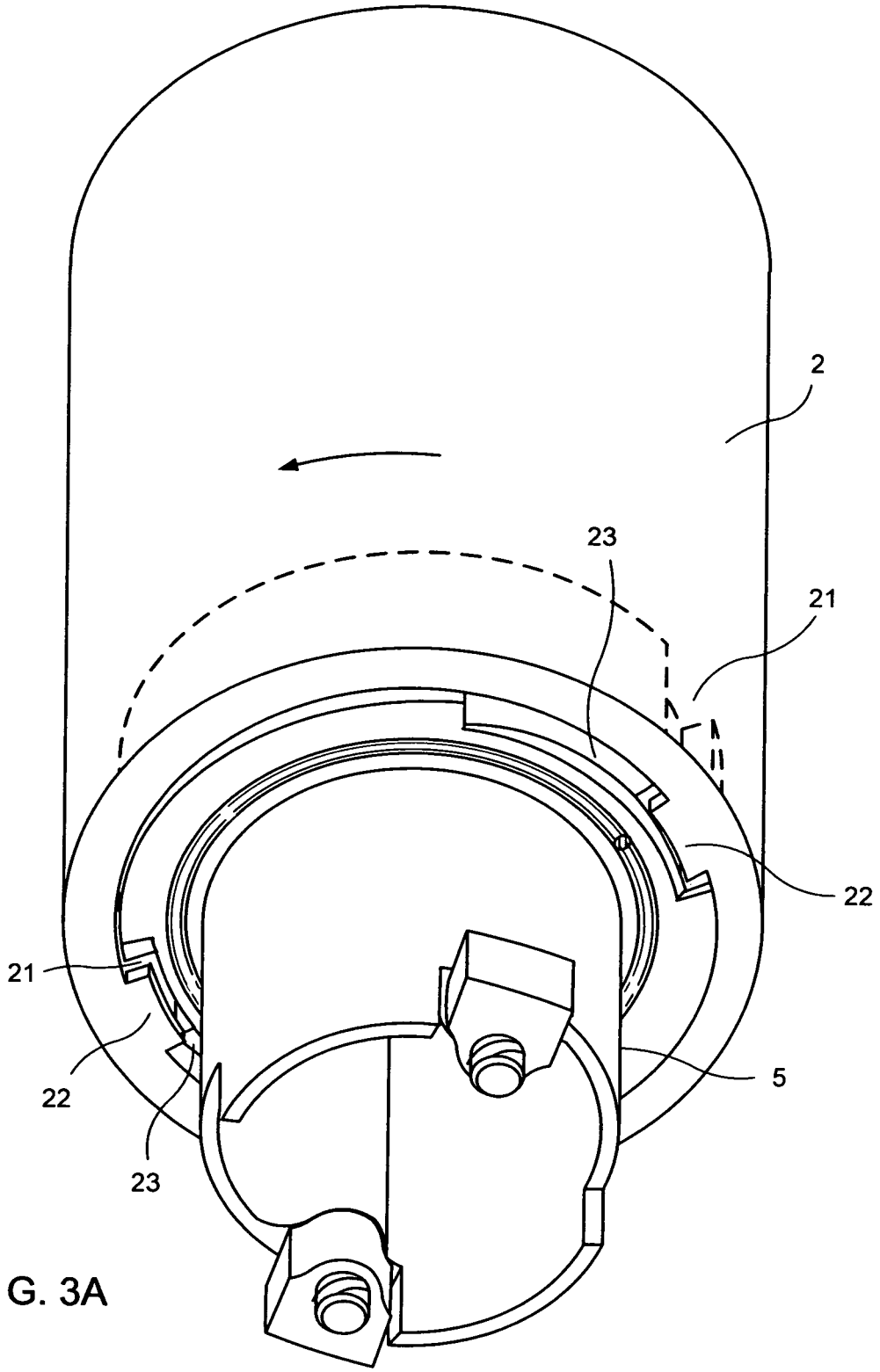
FIG. 3 A is a perspective view first embodiment of the present inventions of FIG. 1 in which the adaptor mechanism has recesses or grooves, preferably two or three on its exterior sidewall and these recesses or grooves matingly slidingly engage the protuberances or tongues on the interior walls at or near to the bottom of the faucet during coupling when the tongues of the faucet are at the bottom of the grooves of the adaptor, the tongues are then located in a track substantially perpendicular to grooves so that when the tongues are in the track and rotated, preferably clockwise it will lock the faucet in place with the adaptor.
FIG. 3B is a sectional view of the first embodiment of the present invention of FIG. 3A in which the adaptor mechanism has recesses or grooves, preferably two or three on its exterior sidewall and these recesses or grooves matingly slidingly engage the protuberances or tongues on the interior walls at or near to the bottom of the faucet during coupling when the tongues of the faucet are at the bottom of the grooves of the adaptor, the tongues are then located in a track substantially perpendicular to grooves so that when the tongues are in the track and rotated, preferably clockwise it will lock the faucet in place with the adaptor.
Figure 3B:
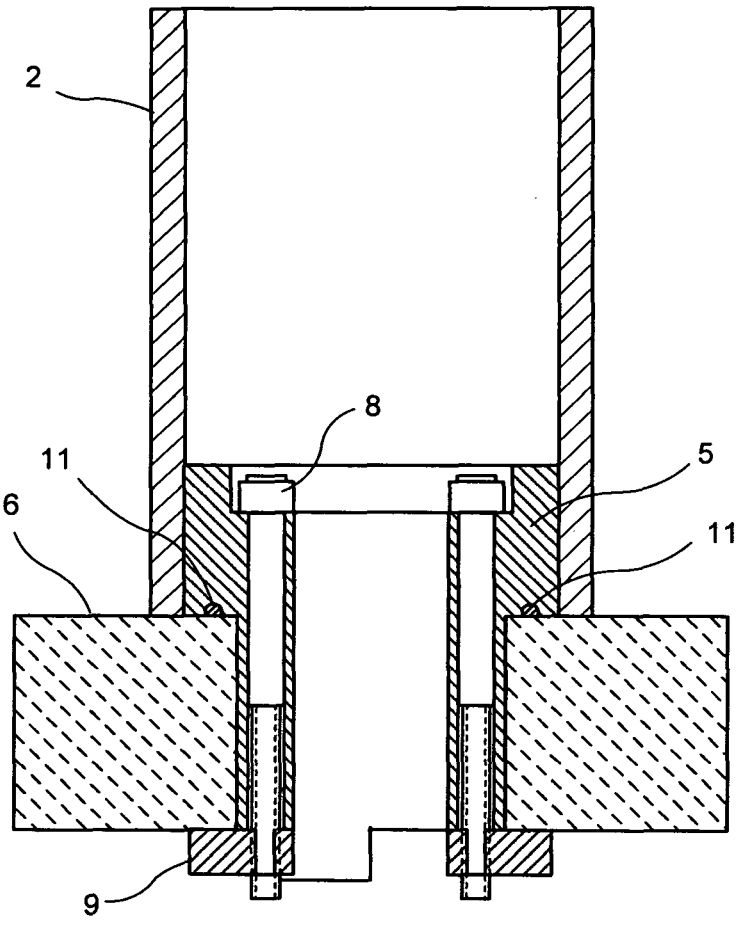

FIGS. 3A-3B illustrate a first embodiment of the present invention of FIG. 1 in which the adaptor mechanism 5 has recesses or grooves 21, preferably two or three on its exterior sidewall and these recesses or grooves matingly slidingly engage the protuberances or tongues 22 on the interior walls at or near to the bottom of the faucet 2 during coupling when the tongues 22 of the faucet 2 are at the bottom of the grooves 21 of the adaptor 5, the tongues 22 are then located in a circumferential track 23 substantially perpendicular to the grooves 21 so that when the tongues 22 are in the track 23 and rotated, preferably clockwise, it will lock the faucet 2 in place with the adaptor 5. The track 23 is tapered so as to be deeper near the recesses 21 and to narrow out in a clock wise direction when the tongues 22 are rotated in track 23.

Figure 4:
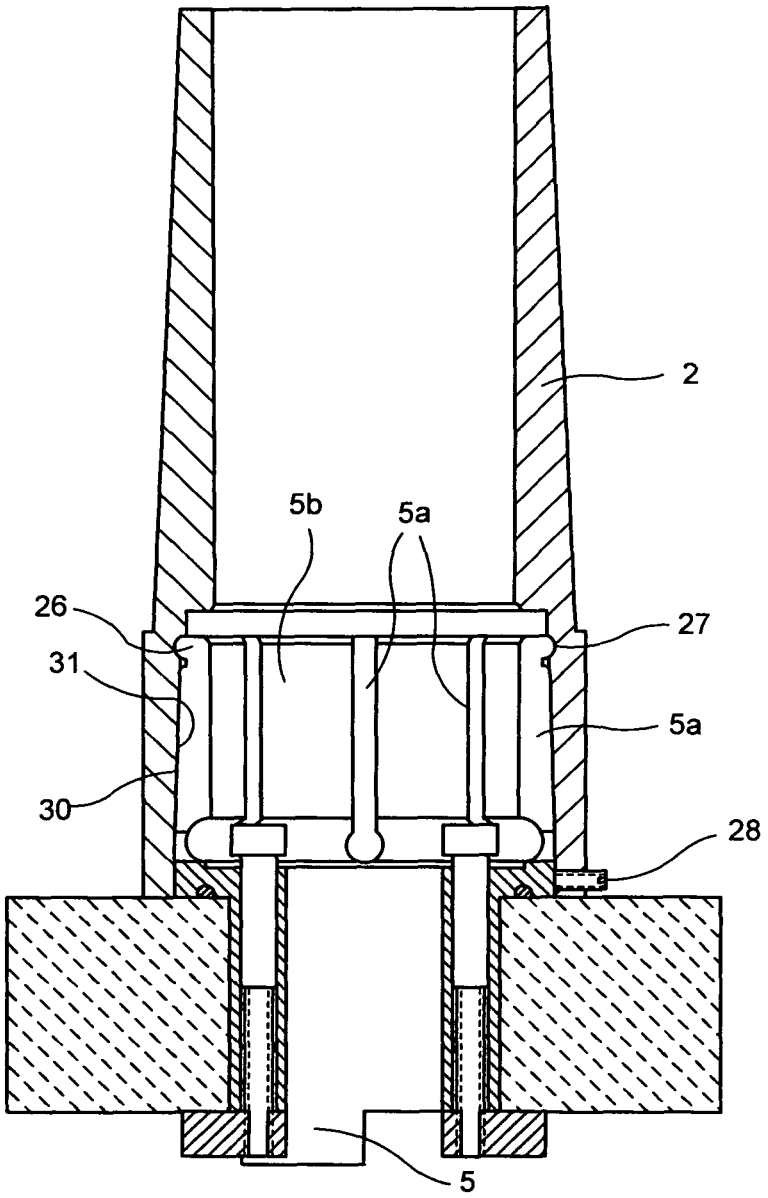
FIG. 4 is a second embodiment of the present invention of FIG. 1 in which the adaptor mechanism has slits on its side wall that will serve as a spring and cause the adaptor side wall to bend inward until the faucet is firmly coupled in place with the adaptor mechanism.

FIG. 4 illustrates a second embodiment of the present invention of FIG. 1 in which the adaptor mechanism 5 has slits 5*a* on its side wall 5*b* that will serve as a spring and cause the adaptor side wall 5*b* to bend inward until the adaptor 5 is firmly coupled in place with the faucet 2. The slits 5*a* cause the sidewall 5*b* of the adaptor mechanism 5 to collapse or compress inward when the faucet 2 is placed over the adaptor 5. The slitted sidewall 5*b* of the adaptor mechanism 5 will expand back to its original circumference within the interior of the faucet 2. The adaptor 5 has at its top part a lip 26 that has a slightly wider diameter, preferably $^{25}/_{1000}$ of an inch than that of the diameter of the slitted wall portion of the adaptor. The slitted wall 5*a* has a taper 30, preferably 1.5 degree taper that is wider at its bottom and narrower at its top part of the slitted wall portion of the adapter 5. The interior sidewall of a faucet 2 has an internal tapering 31 that matches and is complimentary to the tapered wall 30 of the adaptor 5 that is wider on top and narrower at the bottom so that when the faucet 2 is placed over the adaptor, the tapered walls of the faucet force the tapered walls of the adaptor 5 to collapse or bend inward until the lip of the adaptor 5 reaches a groove 27 on the interior sidewall of the faucet 2 so that the adaptor 5 expands and locks the faucet 2 in place with the adaptor 5. A small set screw 28 on the exterior surface of the faucet 2 can set the faucet in place so that the faucet 2 does not rotate. To uninstall it so that the faucet 2 decouples from the adaptor 5, unscrew the set screw 28 approximately three or four turns then wedge a screwdriver between the countertop 6 and the set screw 28 and simply pry the faucet 2 upward to separate from the adaptor 5.

Figure 5:
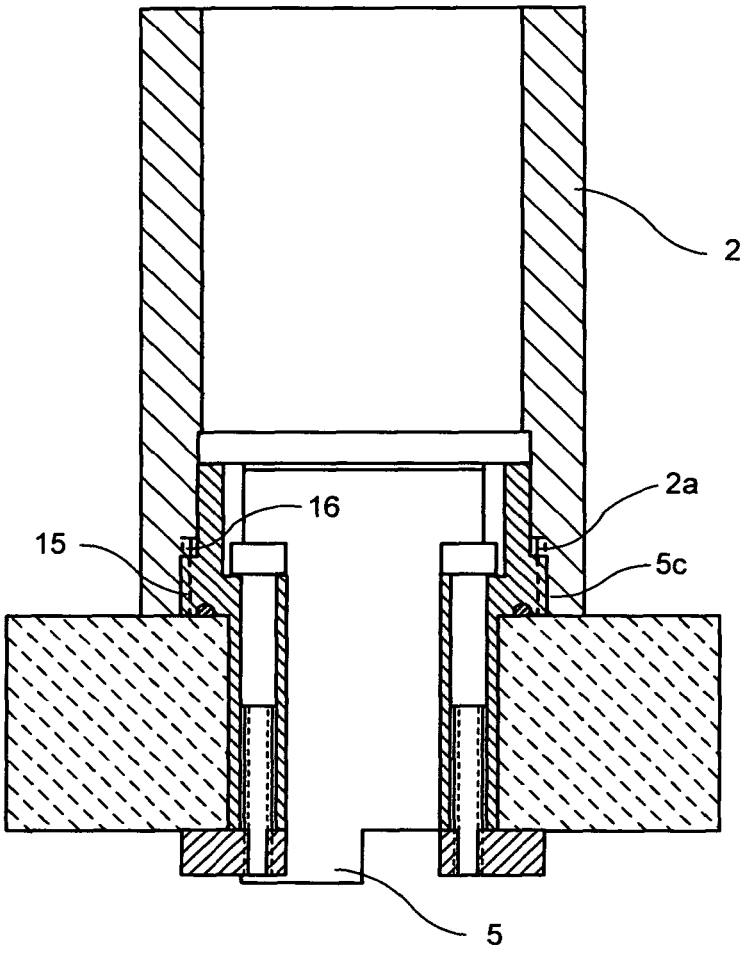
FIG. 5 is a third embodiment of the present invention of FIG. 1 in which the bottom of the adaptor mechanism has a 5 start thread on it exterior bottom surface for quick fastening with the 5 start thread on the interior surface if the sidewall of the faucet so that less than a ¼ circular turn is required to lock the faucet firmly in place with the adaptor mechanism.
Figure 6:
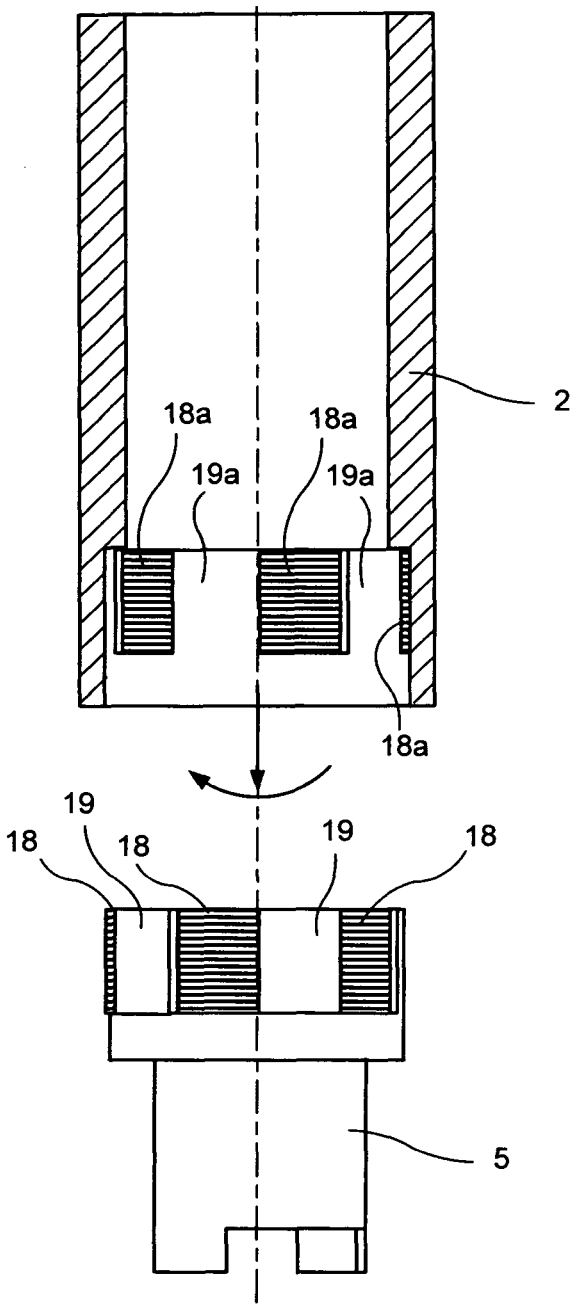
FIG. 6 is a fourth embodiment of the present invention of FIG. 1 in which the adaptor mechanism has a standard thread segmented by preferably 5 recesses on its exterior sidewall and the faucet has a standard thread segmented by preferably 5 recesses on the interior sidewall of the faucet to matingly engage each other.

FIG. 5 relates to a third embodiment of the present invention of FIG. 1 in which the bottom 5*c* of the adaptor mechanism 5 has a 5 start thread 15 on it exterior bottom surface 5*c* for quick fastening with a 5 start thread 16 on the interior surface of the sidewall 2*a* of the faucet 2 so that less than a ¼ circular turn is required to lock the faucet 2 firmly in place with the adaptor mechanism 5 and preferably will turn approximately 50-60 degrees to lock the faucet in place with the adaptor. Thus the adaptor mechanism 5 is threadably engaged to the faucet 2 and is engaged with less than a ¼ circular turn. This makes for a fast installation/removal of the adaptor 5 and the faucet 2 from each other. It is understood that the invention is not limited to a 5 start thread and that any multiple start thread or known multiple thread that can be used instead. A lower number of multiple number of standard thread requires more turning so it will turn more than 50-60 degrees and a higher multiple number of start thread requires less turning than 50-60 degrees. I FIG. 6 shows a fourth embodiment of the present invention of FIG. 1 in which the adaptor mechanism 5 has a standard thread 18 segmented by preferably but not limited to 5 recesses 19 on its sidewall 5*b*. The faucet has a standard thread 18*a* segmented by preferably but not limited to 5 recesses 19*a* on its interior sidewall. When the faucet 2 is placed over the adaptor 5, the recesses 19*a* of the faucet 2 line up with the threaded sections 18 of the adaptor and the threaded sections 18*a* of the faucet line up with the recesses 19 of the adaptor 5 permitting the faucet 2 to slide all the way down over the adaptor 5 and then by rotating the faucet 2, preferably clockwise, the threaded segments 18*a* in the faucet 2 will engage the threaded segments 18 of the adaptor 5 to lock the faucet in place with the adaptor 5. Theses complimentary sets of recesses and threaded segments make for a fast installation and removal for mounting the faucet 2 together with the adaptor mechanism 5. It is understood that that the number of segmenting recesses for the faucet and for the adaptor mechanism can vary but should be the same number for each.

While presently preferred embodiments have been described for purposes of the disclosure, numerous changes in the arrangement of method steps and apparatus parts can be made by those skilled in the art. Such changes are encompassed within the spirit of the invention as defined by the appended claims.

What is claimed:

1. In combination, a faucet, a countertop and an a apparatus for easily installing and removing a faucet to a countertop, comprising:

an adaptor mechanism including an engaging mechanism for coupling said faucet to said countertop, said adaptor mechanism including one or more boreholes into which connecting elements are inserted connecting swinging locks or lugs or feet of said adaptor mechanism so that when said connecting elements are adjusted from above said adaptor mechanism said swinging locks or feet or lugs claps and engage a bottom surface of the countertop to secure said adaptor to said countertop said adaptor mechanism including a first bottom end portion with portions of surface of said adaptor mechanism that extend downward to a second bottom portion that provide a stop rest for said swinging lugs as they swing outward for approximately 180 degrees and rest on their respective sides on said stop rests.

2. The combination according to claim 1 wherein said connecting elements are screws.

3. The combination according to claim 1 wherein said adaptor mechanism has two bore holes into which two connecting elements are inserted.

4. The combination according to claim 1 wherein said faucet includes tongues for slidingly engaging grooves on an interior sidewall of said faucet toward or near a bottom of said faucet to locate said tongues in a circumferential track that is substantially perpendicular to said grooves so that when said tongues rotate within said track, the faucet is locked firmly in place with said adaptor.

5. The combination according to claim 4 wherein said tongues rotate within said track said tongues rotate is in a clockwise direction.

6. The combination according to claim 4 wherein said tongues of said faucet are two tongues.

7. The combination according to claim 1 wherein said adaptor mechanism includes a ring of waterproof material going down into a sink cabinet for said faucet.

8. The combination according to claim 7 wherein said waterproof ring is made of silicon.

9. The combination according to claim 1 wherein said engaging mechanism includes said adaptor mechanism having recesses on its exterior sidewall and said recesses matingly engaging protuberances on an interior sidewall of said faucet for coupling engaging each other.

10. The combination according to claim 9 wherein said recesses on said adaptor mechanism and said recesses on said faucet are each two recesses.

11. The combination according to claim 1 wherein said engaging mechanism includes said adaptor mechanism having slits on its side wall that serve as a spring and cause said adaptor side wall to bend inward until said adaptor mechanism is firmly coupled in place within said faucet and said adaptor mechanism having a top part that has a lip having a slightly wider diameter than that of said slitted wall portion of said adaptor mechanism, said slitted wall portion having a taper wider at its bottom and narrower toward its top portion near said lip and said interior sidewall of said faucet having a matching and complimentary taper to said taper of said adaptor sidewall, said taper of said faucet interior sidewall being that is wider on its top portion and narrower on its bottom portion so that when said faucet is placed over said adaptor mechanism the tapered sidewall of said faucet force the tapered wall of said adaptor mechanism to collapse or bend inward until said lip reaches a groove on said interior side wall of said faucet so that said adaptor mechanism expands and locks said faucet firmly in place with said adaptor mechanism.

12. Combination according to claim 11 further comprising a set screw located on an exterior wall of said faucet to set said faucet in place with said adaptor mechanism so that said faucet does not rotate.

13. The combination according to claim 1 wherein said adaptor mechanism has a five start thread on its exterior bottom surface for quick fastening with a five start thread on a bottom of the interior surface of a sidewall of said faucet to lock the faucet firmly in place with the adaptor mechanism.

14. The combination according to claim 11 wherein said adaptor mechanism is threadably engaged to the faucet with less than a ¼ circular turn to provide for a fast installation/removal of said adaptor and said faucet from each other.

15. The combination according to claim 1 wherein said engaging mechanism includes said adaptor mechanism having a threaded segments thread segmented or separated by recesses on its exterior sidewall and said faucet having complimentary and matching said threaded segments segmented or separated by said recesses on its interior sidewall so that when said faucet is placed over said adaptor mechanism, the recesses said faucet line up with the threaded sections of said adaptor mechanism and the threaded sections of said faucet line up with the recesses of said adaptor mechanism said faucet to slide all the way down over said adaptor mechanism so that when said faucet is rotated, the threaded segments in said faucet engages the threaded segments of said adaptor to lock the faucet in place with said adaptor thereby providing for a fast installation and removal for mounting said faucet together with said adaptor mechanism.

16. The combination according claim 15 wherein said thread can be any number of thread and the number of recesses can be any number that matches the thread number.

17. The combination according to claim 15 wherein said faucet is rotated in a clockwise direction.

* * * * *